US007121431B2

(12) United States Patent
Duke

(10) Patent No.: US 7,121,431 B2
(45) Date of Patent: Oct. 17, 2006

(54) BATTLEFIELD FLASK

(76) Inventor: Larry R. Duke, 2680 Highway 301 South, Jesup, GA (US) 31599

( * ) Notice: Subject to any disclaimer, the term of this patent is extended or adjusted under 35 U.S.C. 154(b) by 0 days.

(21) Appl. No.: 10/839,158

(22) Filed: May 6, 2004

(65) Prior Publication Data

US 2005/0247732 A1 Nov. 10, 2005

(51) Int. Cl.
*B67D 5/06* (2006.01)

(52) U.S. Cl. ..... 222/183

(58) Field of Classification Search ..... 222/183, 222/105, 173, 465, 475, 153.01, 92
See application file for complete search history.

(56) References Cited

U.S. PATENT DOCUMENTS

| | | | | |
|---|---|---|---|---|
| 2,884,151 | A * | 4/1959 | Biederman | 215/329 |
| 3,830,270 | A * | 8/1974 | Hagert et al. | 224/148.5 |
| 5,474,212 | A * | 12/1995 | Ichikawa et al. | 222/105 |
| 5,747,212 | A * | 5/1998 | Kaplan et al. | 430/124 |
| 5,749,497 | A * | 5/1998 | Davis | 222/181.2 |
| 5,906,298 | A * | 5/1999 | Ward | 222/175 |
| 6,510,965 | B1 * | 1/2003 | Decottignies et al. | 222/95 |

* cited by examiner

*Primary Examiner*—Philippe Derakshani
(74) *Attorney, Agent, or Firm*—Dennison, Schultz & MacDonald

(57) ABSTRACT

A retainable reniform-shaped flask for dispensing potable liquids and more particularly to a housing comprising an outer rigid case with a pre-filled inner disposable bag having a spout for dispensing the liquids.

16 Claims, 7 Drawing Sheets

BATTLEFIELD FLASK

BACKGROUND OF THE INVENTION

1. Field of the Invention

As a new device, the present invention relates to a retaining reniform-shaped flask for dispensing potable liquids and more particularly to a housing comprising an outer rigid case with a pre-filled inner disposable bag having a spout for dispensing the liquids.

2. Discussion of the Background

Commercially packaged bottles for water and other soft drinks are used by cyclists, hikers, emergency response teams and military personal alike, and are typically made of a hard synthetic resin such as polyethylene terephthalate (PET). PET does not decompose naturally and therefore impacts negatively upon the environment. Thus, for both the hiker in the fields and mountains and the military personnel in a theater of operations, there exists the problem of disposing with used PET bottles once their content has been consumed. Commercial water bottles are also burdensome to transport since they do not provide a means for attaching the bottle to the user's person.

The U.S. military canteen is another example of a refillable container for carrying and dispensing liquids. The basic design of the refillable canteens used by the military today has essentially remained unchanged throughout World Wars I and II, and the wars in Korea and Vietnam. The most commonly known disadvantage of canteens is that they do not remain sterile once opened and are only capable of being refilled when a source of potable water is available, resulting in considerable logistical problems in a theater of operations.

Container assemblies having an inner container for liquids and an retaining vessel for holding and carrying the bottle are known. U.S. Pat. No. 6,142,344 describes an insulated container assembly that includes an inner, refillable vessel and an outer jacket equipped with straps for carrying the assembly and dispensing the liquid.

U.S. Pat. No. 6,142,344 describes a housing for accommodating therein a container having a spout, and the spout being attached to the package body.

U.S. Pat. Nos. 5,731,021 and 5,904,267 describe other types of containers for carrying and dispensing potable liquids. However, these containers are not suited for the carrying and dispensing of sterile liquids.

Accordingly, there remains a need for a device for carrying and dispensing liquids that overcomes the disadvantages of the known containers.

SUMMARY OF THE INVENTION

It is, therefore, an object of the present invention to provide a cost efficient, storage and retaining dispensing bottle for potable liquids that avoids the disadvantages of the prior art.

Another object of the invention is to provide a personal hydration system having an outer flask casing and a disposable insert for the dispensing of potable liquids such as water in which the inner, biodegradable and disposable insert is removably secured to the neck of the retainable vessel using a tongue and groove seating arrangement.

Another object of the invention is to provide a personal hydration system of the above type that can be mass produced at relatively low cost.

Another object of the invention is to provide a personal hydration system of the above type in which the disposable insert contains water.

DESCRIPTION OF THE DRAWINGS

For a better understanding of the invention as well as other objects and further features thereof, reference is made to the following detailed description to be read in conjunction with the accompanying drawings, wherein.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION OF THE INVENTION

FIGS. 1 through 9 relate to the best mode for carrying out the invention.

Figure 1:
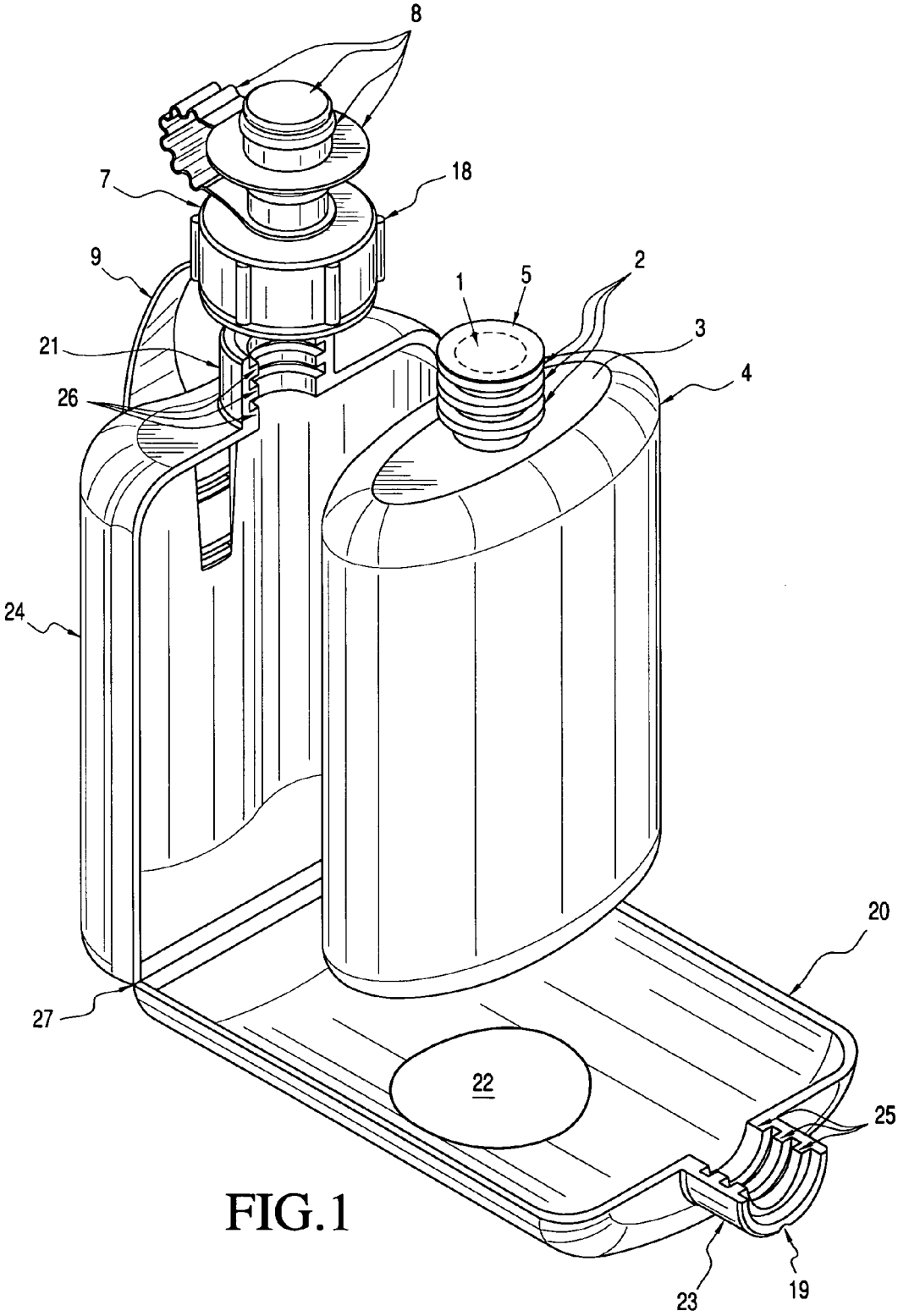
FIG. 1 shows the flask of the invention from a right frontal oblique view.
Figure 3:
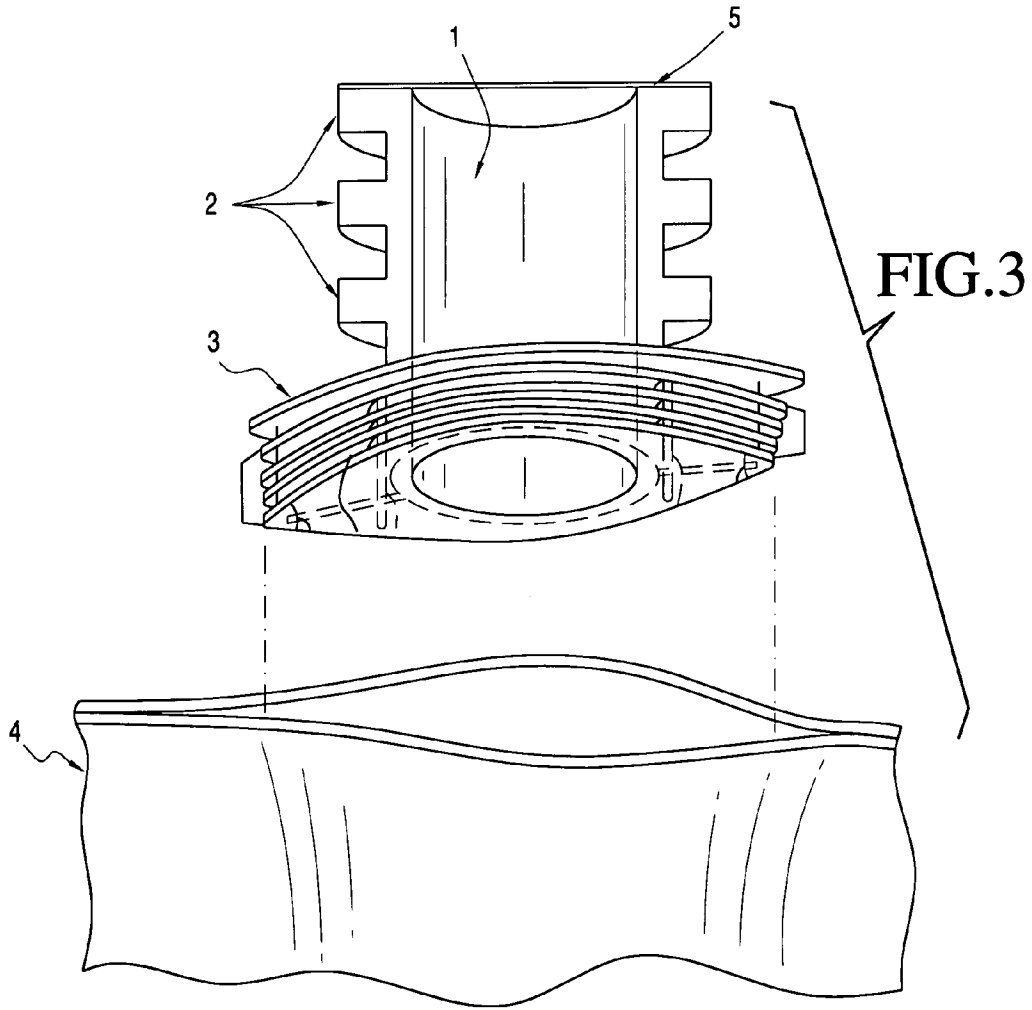
FIG. 3 shows the Disposable Insert, Tongue and Groove Seating Arrangement Assembly.

As seen in FIG. 1, a heat sealed disposable insert will house liquid and semi-liquid products. Packaged in this manner the manufacturers have the option of choosing either a wholly biodegradable disposable insert or one manufactured of thermo-plastic resin. My research has concluded that 99% of all liquid and semi-liquid products currently on the market are conducive to wholly biodegradable packaging. Nonetheless, the preferred embodiments of this invention claim both of these types of materials may be equally affectively applied to this invention. The vast array of colors available in both of these types of materials ensures the manufacturers the ability to maintain their assorted products recognition requirements in the market place, and affords them ample space for logos, labels, etc. However, for the purposes of the new device the preferred embodiments for colors of this invention's disposable inserts are matte Roswell Grey for our nutritionally enhanced liquid unit vitality Meal on the Move (LUV MOM) packaging. Matte Olive Drab will be the color of claim for the standard drinking water packaging. These color claims are necessary to prevent exposure to direct sunlight.

The dispensing and receiving port 1 seen in FIG. 1 from this right frontal oblique and slightly overhead perspective of the disposable insert illustrates an opening of approximately two centimeters. The internal portion of which is the Dispensing and Receiving Port 1. Throughout this detailed description of the preferred embodiments for this invention the numerical one 1 is indicative of this Dispensing and Receiving Port 1 as it travels first, though the Nozzle Locker Assembly's Internal Foil Seal Perforator 17, then through the Nozzle Locker Assembly External Dispensing Port Vertical Protrusion 11 which is the portion that is placed to the user's lips for drinking. The Disposable Insert, Tongue and Groove Seating Arrangement Assembly 2, as seen in FIG. 1, illustrates the method in design of how the disposable insert is to be manufactured as a wholly biodegradable freestanding one piece unit.

Te Disposable Insert, Packaging Body 4 seen in FIG. 1 has a Foil Heal Seal 5 which is attached to the flat surface of the top tier of the Disposable Insert, Tongue and Groove Seating Arrangement Assembly 2 which extends six millimeters around the circumference of the Dispensing and Receiving Port 1 is to prevent spillage or leakage. Constructed of wholly biodegradable materials and in the same reniform pattern as the receiving retainable vessel with a concave and convex side complimenting the Retainable Vessel, Aft Section, Body 24 and the Retainable Vessel, Fore Section Body 20, respectively. Conversely, half of the Disposable Insert, Tongue and Groove Seating Arrangement Assembly 2 fits exactly into the Retainable Vessel, Aft Section Groove and Tongue Seating Receiving Assembly 26. At the point of complete closure, the Retainable Vessel, Fore Section Groove and Tongue Seating Receiving Assembly 25 fits exactly with the Disposable Inserts, Tongue and Groove Seating Arrangement Assembly's 2 other half. The Disposable Insert packaging Body Seat 3 is that elliptical portion found directly underneath and combined in uniformity with the Disposable Insert, Tongue and Groove Seating Arrangement Assembly 2 as a whole. Comprising the disposable insert's whole upper torso and shoulders this Disposable Insert, Packaging Body Seat 3 is constructed of the same rigid biodegradable material in thickness and density as those measurements prescribed for the Disposable Insert, Tongue and Groove Seating Arrangement Assembly 2 shown in FIG. 2. Being the sole support of the Disposable Insert, Packaging Body 4 the thickness and density of this elliptical portion shall be maintained down to the intersection seen in FIG. 1 where the Disposable Insert, Packaging Body Seat 3 and the Disposable Insert, Packaging Body 4 meet. The Disposable Insert, Packaging Body 4 may be constructed of a much lighter less dense biodegradable material.

Figure 2:
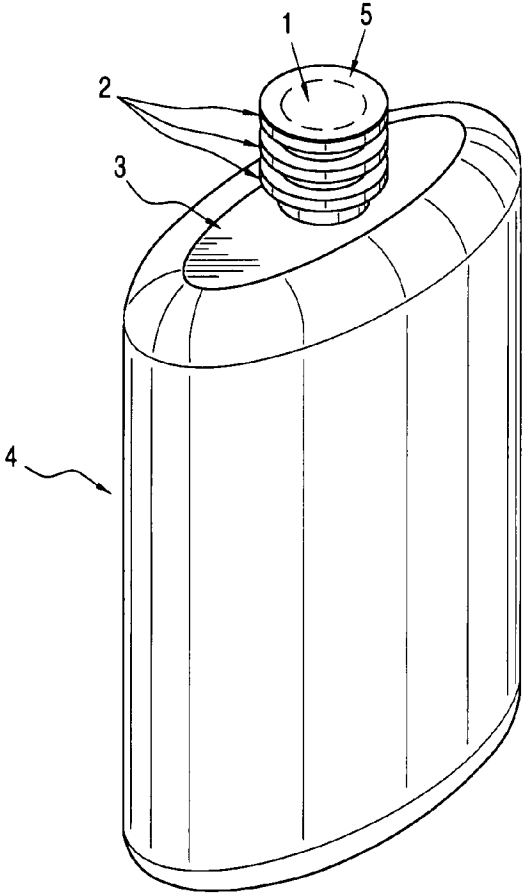
FIG. 2 shows the disposable insert.

FIG. 2 shows a blown up view of the Disposable Insert, Tongue and Groove Seating Arrangement 2 illustrating manufacturing and assembly of components made of thermo-plastic resin through employment of the blow mold injection process. The solid line traversing the top of the Disposable Insert, Tongue and Groove Seating Arrangement Assembly 2 is the Disposable Insert, Foil Heal Seal 5 covering the Dispensing and Receiving Port 1.

The Disposable Insert, Packaging Body Seat 3 (FIG. 3) is that elliptical portion seen directly underneath and combined in uniformity with the Disposable Insert, Tongue and Groove Seating Arrangement Assembly 2 as a whole. The only significant difference is the tier of heat-sealing ridges necessary to attach the Disposable Insert, Packaging Body 4 to the Disposable Insert, Packaging Body Seat 3 and the Disposable Insert, Packaging Body 4 is shown as a double-layered plastic pouch for containment of the water.

Figure 4:
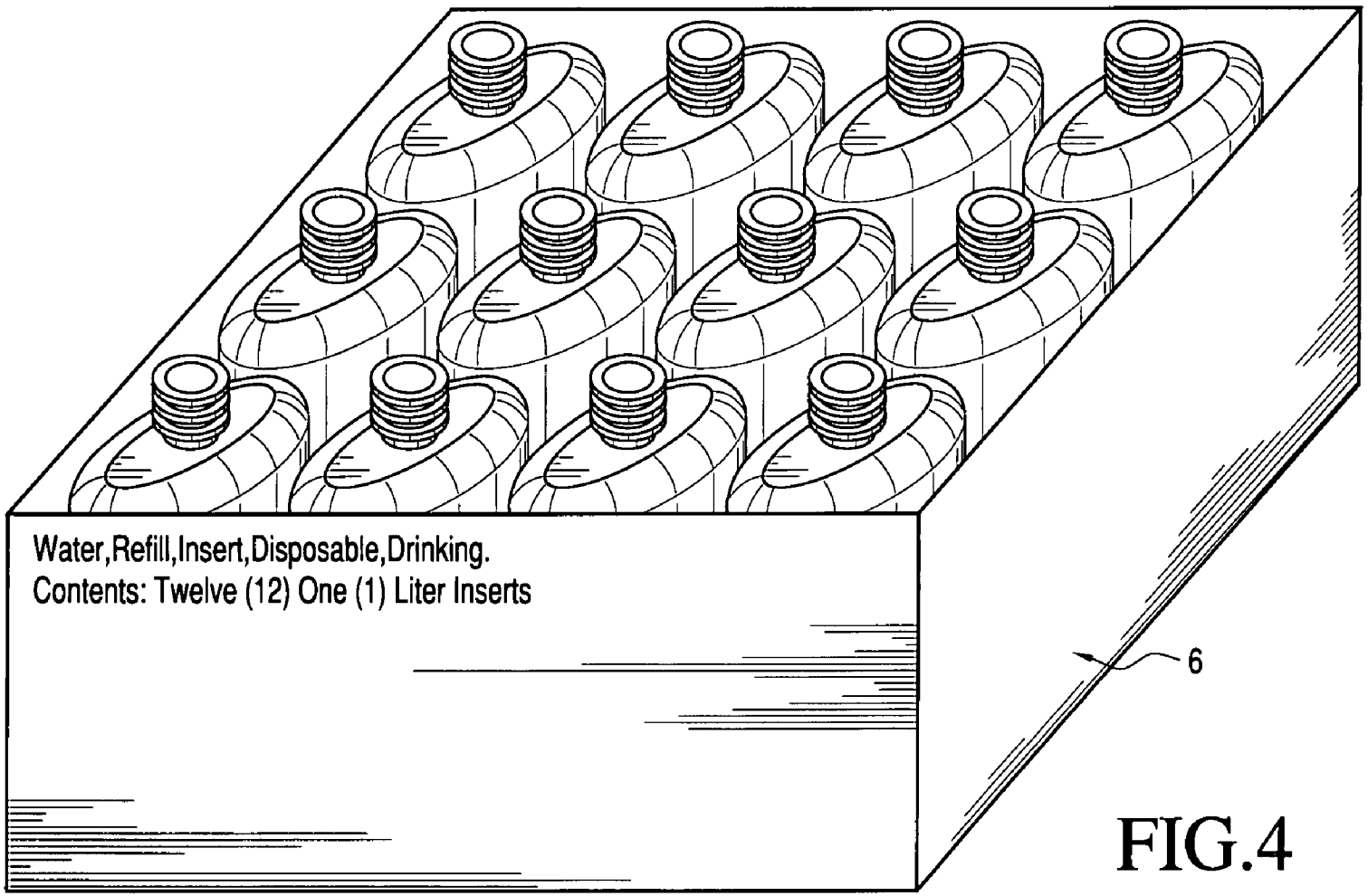
FIG. 4 shows twelve disposable inserts packaged as a unit.
Figure 5C:
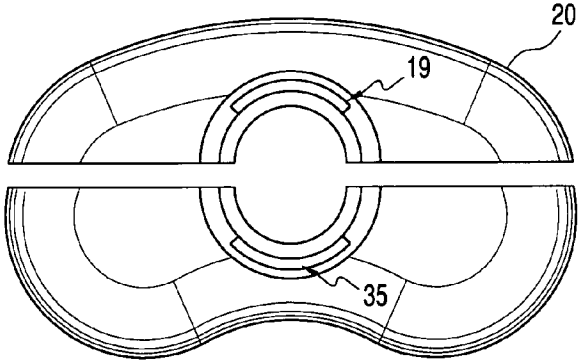
FIG. 5 shows the Nozzle Locker Assembly and its internal and external components.
Figure 5D:
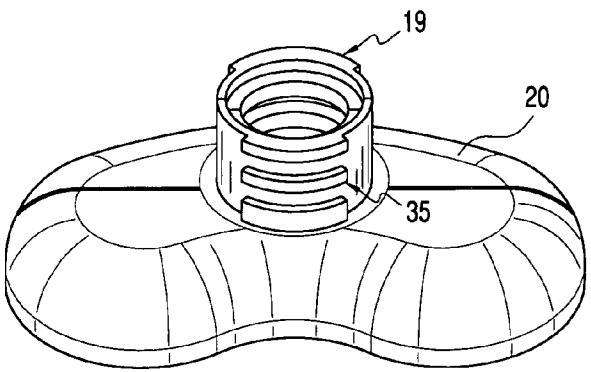
Figure 5E:
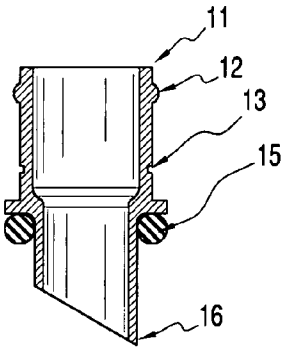
Figure 5A:
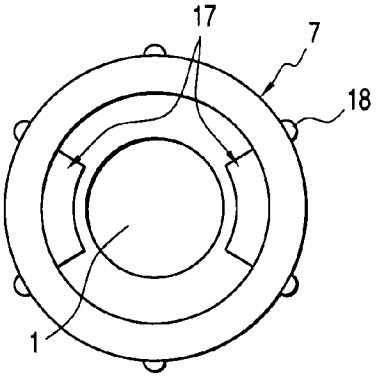
Figure 5B:
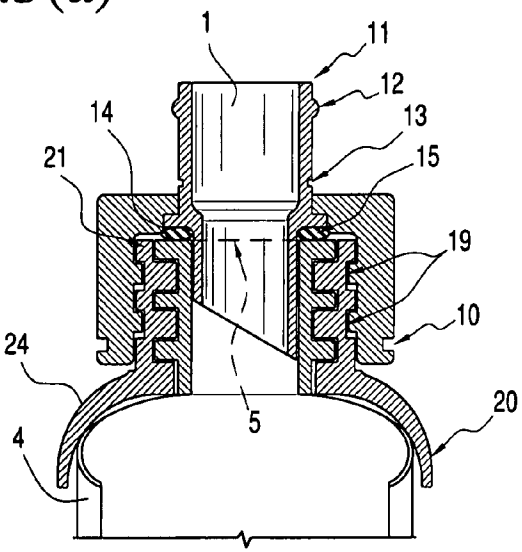

FIG. 4 shows the Disposable Insert, Packaging Box 6, and is part of the system of hydration of the invention. Preferably, the disposable insert refills are boxed head to toe in a single column rather than the way seen in FIG. 4.

Figure 6C:
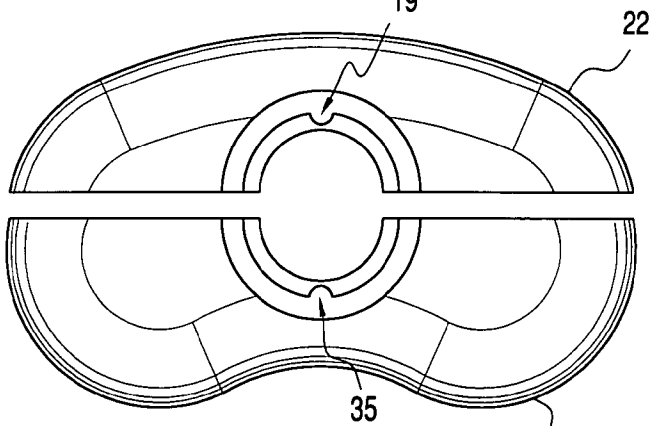
FIG. 6 shows another embodiment of the Nozzle Locker Assembly.
Figure 6B:
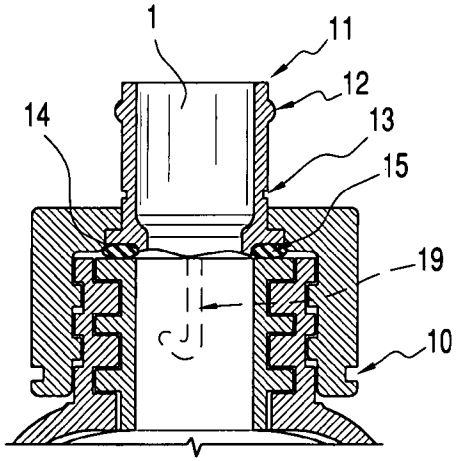
Figure 6A:
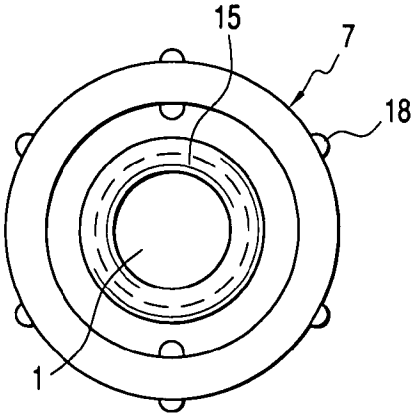

FIGS. 5 and 6 show the Nozzle Locker Assembly 7. The Nozzle Locker Assembly 7 is the lynchpin of this invention and as its name implies, requires assembly. Manufactured of a thermo-plastic resin through extrusion and blow mold injection process, and as an individual component separately from the manufacturing of the retainable vessel itself, it is also manufactured separately from the Nozzle Locker Retaining Strap 9 and the Nozzle Locker Dispensing Port Cap and Retaining Strap 8 as well. Round in stature with a radius of 2.5 centimeters and an overall height of 4.7 centimeters, this portion of the Nozzle Locker Assembly 7 has a smaller round vertical protrusion at its center with a radius of 1.2 centimeters and an overall height of 1.8 centimeters. This smaller round vertical protrusion extending from the top of the Nozzle Locker foundation is the Nozzle Locker Dispensing Port Vertical Protrusion 11. About the circumference of the upper external walls of the Nozzle Locker Dispensing Port Vertical Protrusion 11 exists a ridge 0.3 millimeters below its highest point to the ridge's center. The ridge is the Nozzle Locker Dispensing Port Cap Closing Ridge 12 because of the precise function it performs. The ridge is 0.2 millimeters in width with a 0.1 millimeter protruding lip for the retention of the Nozzle Locker Assembly, Dispensing Port Cap 8.

Directly below the Nozzle Locker Assembly, Dispensing Port Cap Closing Ridge 12 located 1.3 centimeters beneath the ridge's center is the Nozzle Locker Assembly, Dispensing Port Cap and Retaining Strap Groove 13 which is 0.2 of a millimeters in depth and serves to connect the Nozzle Locker Assembly Dispensing Port Cap and retaining Strap to the Nozzle Locker Assembly, Dispensing Port Vertical Protrusion 11 to prevent separation or loss.

Figure 7:
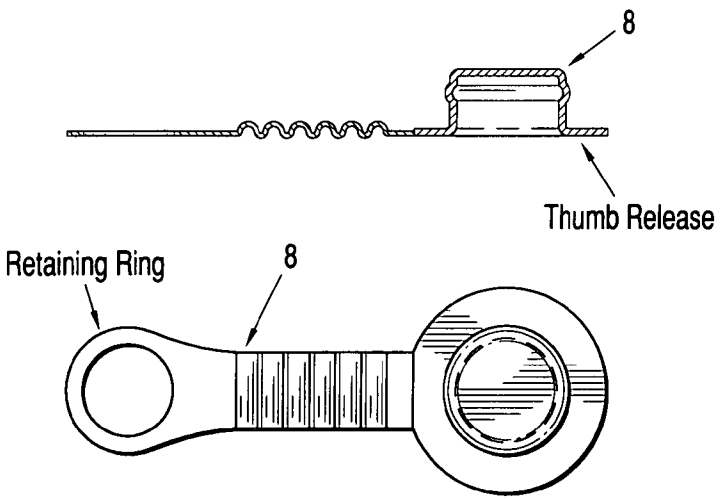
FIG. 7 shows the Nozzle Locker Assembly, Dispensing Port Cap and Retaining Strap with Thumb Release.

FIG. 7 shows the Nozzle Locker Assembly, Dispensing Port Cap and Retaining Strap with Thumb Release 8. Manufactured by the blow mold injection process as a single press item the actual cap is a round vertical protrusion surrounded by a flat 0.7 millimeter extension which is used to remove the cap from the Nozzle Locker Assembly, Dispensing Port Cap Closing Ridge 12 with a flip of the thumb. Consequently, the flat extension surrounding the actual cap is called the Thumb Release. The corresponding internal closing groove is an internal groove encircling the actual cap's interior approximately 3 millimeters below the snap cap's top enclosure to ensure complete closure. The complete closure is accomplished by snapping the cap over the Nozzle Locker Assembly, Dispensing Port Cap Closing Ridge 12. The retaining strap which is manufactured in the mold attaches to the outer edge of the thumb-release and the thumb release is molded to the cap. The center portion of the retaining strap is serpentine in design to allow flexibility in the motion of opening and closing, with the majority of the total flexation required when the cap is fully secured and will remain in the closed position for an indefinite period of time. The serpentine design is also needed to insure the retaining strap's life expectancy. The free end of the retaining strap, that portion which extends from where the serpentine design ends to that portion which encircles the Nozzle Locker Assembly, Dispensing Port Cap and Retaining Strap Groove 13. To accomplish this assembly, the interior circumference of the retaining strap circle which slips over the Nozzle Locker Assembly, Dispensing Port Vertical Protrusion 11 has 1 millimeter deep cuts dividing the internal circumference into quarter sections which snaps into the 2 millimeter deep groove. The Nozzle Locker Assembly Retaining Strap 9 is also manufactured as a separate one-piece item. It is then attached to the Nozzle Locker Assembly, Retaining Strap Groove 10 in much the same fashion as described above for the cap retaining strap. However, both the thickness of the Nozzle Locker, Retaining Strap 9 and the depth of the Nozzle Locker Assembly Retaining Strap Groove 10 are greater than that of the Nozzle Locker Assembly, Dispensing Port Cap and Retaining Strap 8 and corresponding receiving groove. Both grooves are designed to allow complete 360° rotations of both the Nozzle Locker Assembly 7 and the Nozzle Locker Assembly, Dispensing Port Cap and Retaining Strap 8. And of course the obvious Nozzle Locker Assembly External Gripping Fins 18 are designed to assist in the ease of turning the Nozzle Locker Assembly 7 and they are an incorporated whole of the assembly. FIG. 5(*a*) shows an internal bottom view of the Nozzle Locker Assembly 7. At this views center is the Dispensing and Receiving Port 1 as seen looking through the hole of the Nozzle Locker Assembly Internal Foil Heat Seal Perforator 16 encircled by the Nozzle Locker Assembly Internal "O" Ring 15.

Although it can't be seen from this perspective one can imagine that the Nozzle Locker Assembly, Internal "O" Ring 15 is seated in the Nozzle Locker Assembly, Internal "O" Ring Groove 14. Stationed inside the Nozzle Locker Assembly 7 on the perimeter of its internal circumference at 180° opposites are the Nozzle Locker Assembly, Internal Locking Linkage 17 nodes. These nodes are recessed into the Nozzle Locker assembly's internal cavern at such a depth so as to allow the necessary downward movement of the Nozzle Locker Assembly, Internal Foil Seal Perforator 16 to pierce the Disposable Insert's Foil Heal Seal 5 by traveling into and down the length of the Retainable Vessel, Fore Section Nozzle External, Locking Track 19 and the Retainable Vessel, Aft Section Nozzle, External, Locking Track 35 at the same time. When this action occurs, and the nodes reach the bottom of the locking tracks, a slight clockwise turn of the assembly will then move the nodes into their locked position, which is a slightly elevated position from its foremost downward departure, yet leaving the "O" Ring in a state of compression to prevent leakage. FIG. 5(*b*) shows a fore frontal see through elevation of the Nozzle Locker Assembly 7. FIG. 5(*c*) is a top view of the retainable vessel's fore and aft halves as seen from directly overhead to illustrate the entries into the fore and aft nozzles of the Retainable Vessel, Fore Section Nozzle, External, Locking Track 19 and the Retainable Vessel, Aft Section Nozzle, Locking Track 35 respectively.

FIG. 5(*e*) is an isolated view of the centerpiece of the Nozzle Locker Assembly 7.

FIG. 6 shows another embodiment of the nozzle locker. From the perspectives seen in FIG. 6 you will notice first the locking linkage nodes have changes. The new locking linkage tabs are two deep rather than one like before in FIG. 5 and they have an equal space between them. A space which is of equal thickness to their individual size. You can see it perfectly in FIG. 6 (*b*) in the form of the locking linkage tracks seen on the outside of the retainable vessel's fore and aft nozzle, but nothing which really shows the locking linkage tabs themselves. FIG. 6(*c*) shows the fore and aft sections of the retainable vessel and the cut-away portions of the nozzles, half the length of the locking linkage tabs on each half of the fore and aft nozzle allows the tabs to move downward in the closing process so that they become aligned with those portions of the locking linkage tracks which are formed into the walls of the remaining uncut portions of the fore and aft nozzles. Turning of the Nozzle Locker Assembly places them firmly into place in the locked position. The top half of each of the locking linkage tracks have a small serrated directional receiving ridge of one millimeter which corresponds to one millimeter directional teeth on the center of each of the locking linkage tabs. By compressing the "O" ring with hand pressure the locking linkage tabs are turned into place and when released will lock into place. You may actually hear the clicking aloud to a very small degree and this is one of primary concerns in using this type of locking mechanism over the one shown in FIG. 5. Sound is a very critical matter in combat. To obtain release, the user must simply apply downward hand pressure, again compressing the "O" ring, and turn while maintaining his/her hand pressure until the locking linkage tabs are clear of the locking linkage tracks. The remainder of any information contained in FIG. 6 has already been expressed in FIG. 5.

Figure 8:
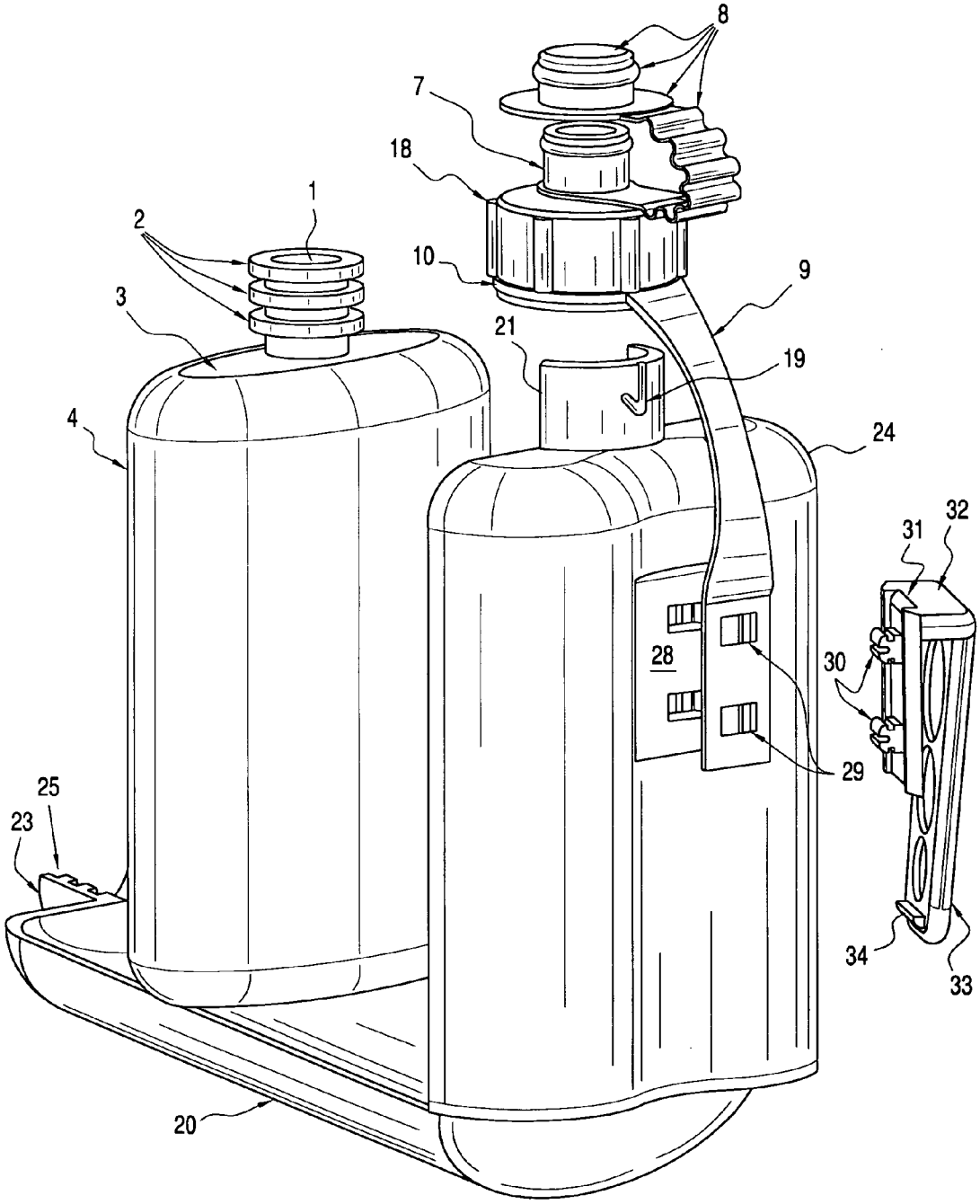
FIG. 8 shows a rear right oblique view of the retainable vessel in an opened posture with the disposable insert poised for placement/removal.

FIG. 8 shows a left rear oblique perspective the Retainable Vessel, Fore Section Body, External 20 is seen face down in a 90° separation from the Retainable Vessel, Aft Section Body, External 24 with only the tip of the Retainable Vessel, Fore Section Nozzle External 23 visible, as is even a lesser portion of the Retainable Vessel, Fore Section, Groove and Tongue Seating Receiving Assembly, Internal 25 seen. The Retainable Vessel, Aft Section Cuneiform Wedge, Belt Clip Housing, external 28 is an incorporated feature of the one piece construction of the retainable vessel. This cuneiform wedge sits in the concave portion of the retainable vessel aft, external section to provide a flat, thick sturdy housing to accommodate fastening the belt clip to the retainable vessel, and is formed by mold extrusion with two rectangular housing holes. These holes are also stamped though the flat rectangular end of the Nozzle Locker Assembly, External Retaining Strap 9 which is designed to incorporate a three way marriage at this junction. The marriage occurs when the flat rectangular end of the Nozzle Locker Assembly, External, Retaining Strap 9 is placed into the Belt Clip Seating Groove for the Nozzle Locker Retaining Strap 31 and the Belt Clip Directional Fasteners 30 are inserted through the holes of the retaining strap then through the Retainable Vessel, Aft Section, Belt Clip Housing Holes 29 contained within the Retainable Vessel, Aft Section, Cuneiform Wedge, Belt Clip Housing, External 28. These bull-nosed directional fasteners 30 are of such a length and design to ensure a flush, secure mounting. Manufactured as a separate piece from those of the retainable vessel, the nozzle locker retaining strap, the nozzle locker dispensing cap and strap and the nozzle locker itself, the belt clip and its elements are manufactures through the blow mold injection process, but are manufactured of a more rigid thermoplastic resin than are the other components. Still it is a uniform design with five distinct elements. The Belt Clip Clasp retainer 34 is a quarter round horizontally upward positioned bar intersecting the fore side of the clasp at its bottom. A three millimeter projection in mold design to assist in security against unwanted separation from the belt. The Belt Clip Clasp 33 is the vertical aft side element which is attached to the Belt Clip, Top Section 32 at a 70° angle to assist in maintaining adequate inward pressure against the belt. The Belt Clip Clasp 33 has three independent round holes of varied diameters through its center with the smaller diameter hole being located at its bottom the gradual increase of the hole diameters gain in proportion towards the Belt Clip Top Section 32.

Figure 9:
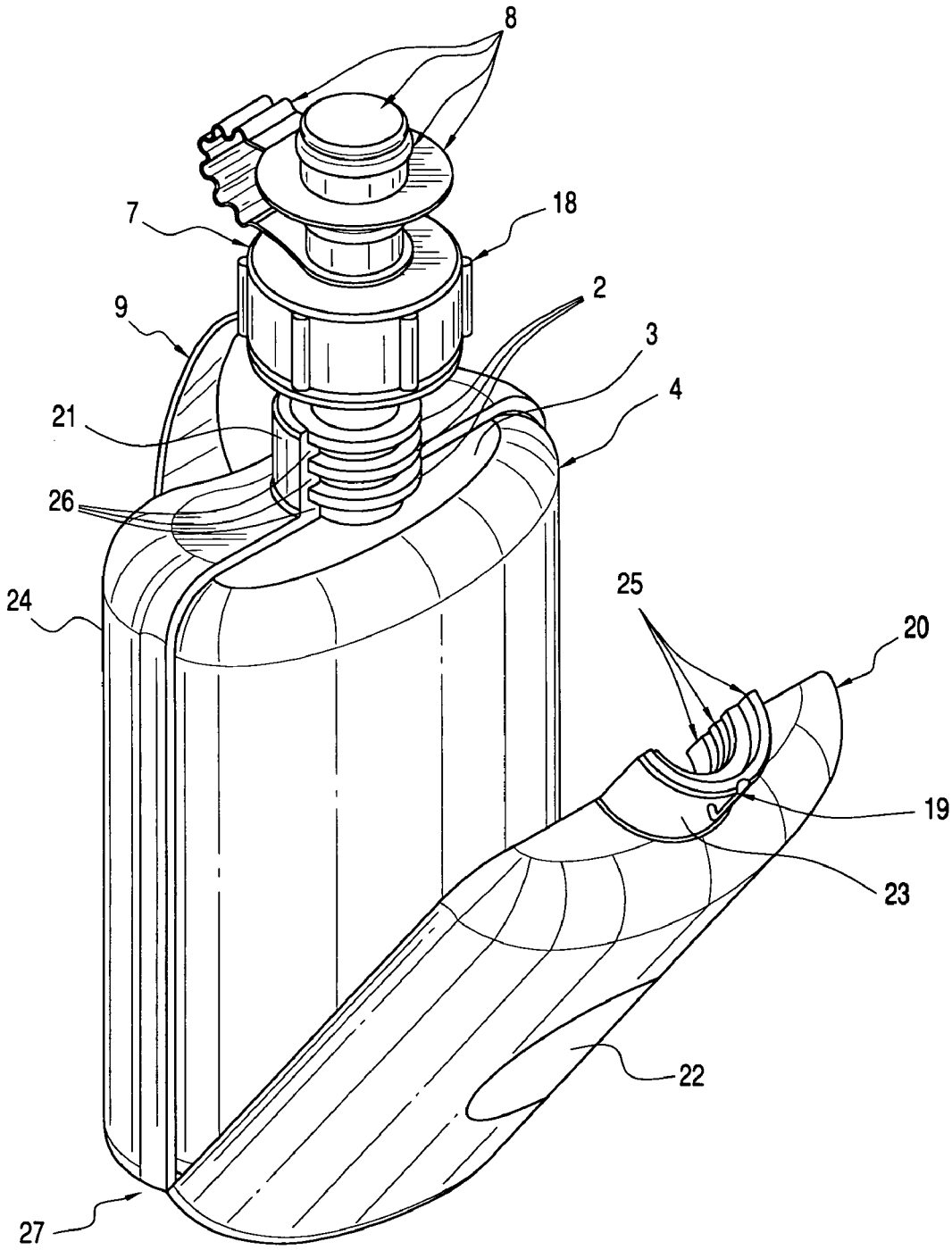
FIG. 9 shows a frontal right oblique view of the retainable vessel with the disposable insert seated in the vessel's aft section while the vessel's fore section is seen in a partial opened posture.

FIG. 9 shows a frontal right oblique view of the retainable vessel with the disposable insert seated in the vessel's aft section while the vessel's fore section is seen in a partial opened posture.

A preferred embodiment has been described in detail and a number of alternatives have been considered. As changes in or additions to the above-described embodiments may be made without departing from the nature, spirit or scope of the invention, the invention is not to be limited by or to those details, but only by the appended claims or their equivalents.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as new and useful and desired to be secured by Letters Patent is:

1. A flask, comprising:

an outer case having a first half portion and a second half portion;

a hinge means pivotally connecting said first half portion with said second half portion at a lower side thereof, wherein said first half portion and said second half portion bound a space therebetween in a closed configuration;

said first half portion comprising a first neck portion extending from an upper side thereof, and said second half portion comprising a second neck portion extending from an upper side thereof, wherein said first neck portion flushes against said second neck portion when said flask is in a closed configuration and forming a substantially cylindrical neck portion having an upper periphery and a bore providing access to said space;

said cylindrical neck portion having a plurality of grooves continuously extending in a horizontal direction around the inner peripheral surface of said cylindrical neck portion;

a cap removably securable to said cylindrical neck portion;

a container having a neck portion having an upper periphery and including a plurality of ridges continuously extending in a horizontal direction around an outer periphery of said container neck portion and dimensioned and configured to removably engage with plurality of grooves on said outer case neck portion securing said container within said space between said first and said second half portions; said upper periphery of said container defining an opening; said neck portion having a bore providing access to said container;

wherein said upper periphery of said neck portion of said container is flushed with and on the same plane as said upper periphery of said outer case cylindrical neck portion when said container is disposed within said space and said outer case is in a closed configuration.

2. A flask according to claim 1, wherein said cap comprises a cap body having a substantially cylindrical configuration and a vertical wall defining an interior space and bounding a lower opening that provides access to said interior space; said cap body having an inner vertical wall and a top portion defined by a flat surface having a bore substantially extending therethrough;

a spout member disposed within said interior space of said cap; said spout member having a substantially cylindrical configuration; said spout member having an upper end, a central portion, and a lower end, and a bore extending from said upper end to said lower end of said spout member; said upper end of said spout member extending through said bore of said cap body; said lower end of said spout member being defined by a substantially angular configuration; said spout member having an annular ring extending in a horizontal direction around the periphery of said central portion thereof, wherein the diameter of said annular ring is greater than the diameter of said bore of said cap body to retain the spout member within said interior space of said cap body; and an O-ring disposed on said spout member to provide a seal between said upper periphery of said container and said bore of said spout member when said cap is secured to cylindrical neck portion of said outer case.

3. A flask according to claim 2, wherein said upper portion of said spout member comprises an annular ridge extending in a horizontal direction around the periphery thereof.

4. A flask according to claim 3, wherein a cover is disposed on said upper end of said spout member and releasably engages said annular ridge.

5. A flask according to claim 1, wherein said cap is secured to said cylindrical neck portion using a locking means.

6. A flask according to claim 5, wherein said locking means comprises a plurality of opposing locking ridges partially extending in a horizontal direction around said inner vertical wall of said cap body; and a plurality of opposing locking grooves partially extending in a horizontal direction around said outer periphery of said cylindrical neck portion of said outer case and dimensioned and configured to removably engage with said plurality of ridges on said inner vertical wall of said cap body; such that said opposing locking ridges engage and travel along said opposing locking grooves when said cap is placed on said cylindrical neck portion of said outer case, and wherein a slight clockwise movement of said cap secures said cap onto said cylindrical neck portion of said outer case.

7. A flask according to claim 5, wherein said locking means comprises a pair of opposing linkage nodes disposed on said inner vertical wall of said cap body, and a pair of opposing linkage tracks in said outer peripheral surface of said cylindrical neck portion of said outer case, said linkage tracks comprising a vertical portion having a lower end and an angular portion extending upwardly from said lower end; such that said opposing linkage nodes engage and travel along said vertical portion of said opposing linkage tracks when said cap is placed on said neck portion of said outer case, and wherein a clockwise movement of said cap when said linkage nodes reach said lower end of said linkage tracks causes said linkage nodes to move into said angular portion of said linkage track and thereby secure said cap onto said cylindrical neck portion of said outer case.

8. A flask according to claim 1, wherein a seal is disposed on said upper periphery of said container neck portion.

9. A flask according to claim 8, wherein said seal is a foil heat seal.

10. A flask according to claim 8, wherein said lower end of said spout member perforates said seal of said inner container when said cap is engaged on said neck portion of said outer case.

11. A flask according to claim 1, wherein a retaining strap connects said cap to said outer case.

12. A flask according to claim 4, wherein a retaining strap connects said cover to said spout member.

13. A flask according to claim 1, wherein said container substantially fills the space defined by said first half portion and said second half portion of said outer case in a closed configuration.

14. A flask according to claim 1 which is substantially reniform in shape.

15. A flask according to claim 1, further comprising a means for attaching said flask to a user's clothing.

16. A flask according to claim 15, wherein said means is a clip for attaching said flask to a user's belt.

* * * * *